United States Patent [19]

Hayashi

[11] Patent Number: 4,633,822

[45] Date of Patent: Jan. 6, 1987

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[21] Appl. No.: 640,862

[22] Filed: Aug. 15, 1984

[30] Foreign Application Priority Data

Aug. 25, 1983 [JP] Japan ..... 58-155277

[51] Int. Cl.[4] ..... F01P 3/22

[52] U.S. Cl. ..... 123/41.21; 123/41.27

[58] Field of Search ..... 123/41.2, 41.21, 41.22, 123/41.23, 41.24, 41.25, 41.26, 41.27, 41.3, 41.54; 165/104.27

[56] References Cited

U.S. PATENT DOCUMENTS

| | | | |
|---|---|---|---|
| 1,376,086 | 4/1921 | Fairman | 123/41.14 |
| 1,787,562 | 1/1931 | Barlow | 123/41.03 |
| 1,792,520 | 2/1931 | Weinhardt | 123/41.14 |
| 1,806,382 | 5/1931 | Barlow | 123/41.2 |
| 2,292,946 | 1/1941 | Karig | 123/41.2 |
| 2,413,770 | 1/1947 | Knoy | 123/41.21 |
| 2,420,436 | 5/1947 | Mallory | 123/41.02 |
| 3,981,279 | 9/1976 | Bubniak et al. | 123/41.14 |
| 4,367,699 | 1/1983 | Evans | 123/41.23 |

FOREIGN PATENT DOCUMENTS

| | | | |
|---|---|---|---|
| 0059423 | 9/1982 | European Pat. Off. . | |
| 527342 | 6/1931 | Fed. Rep. of Germany . | |
| 736381 | 6/1943 | Fed. Rep. of Germany . | |
| 5757608 | 11/1976 | Japan . | |
| 57-8312 | 1/1982 | Japan | 123/41.08 |
| 57-16219 | 1/1982 | Japan . | |
| 931087 | 7/1963 | United Kingdom . | |

*Primary Examiner*—William A. Cuchlinski, Jr.

*Attorney, Agent, or Firm*—Schwartz, Jeffery, Schwaab, Mack, Blumenthal & Evans

[57] ABSTRACT

In an internal combustion engine cooling system wherein the coolant is boiled and the vapor produced condensed in a radiator in a manner that the rate of condensation under light engine load is maintained at a level sufficiently low to raise the pressure within the system and thus raise the boiling point of the coolant while under heavy load increased to the point of lowering the pressure in the system and thus lower the coolant boiling point, a reservoir/valve arrangement is provided which permits additional coolant to be inducted into the system, in the event that an excessively low or negative pressure occurs (due to uncontrollable external influences), under the influence of the pressure differential which is established between the ambient atmosphere and the interior of the system. The coolant thus inducted is permitted to be displaced back out to the reservoir only when the temperature and pressure in the system is restored to the desired level.

11 Claims, 15 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is boiled to make use of the latent heat of vaporization of the same and the vapor used as a vehicle or removing heat from the engine, and more specifically to such an engine wherein the pressure within the cooling system can be varied in order to vary the boiling point of the coolant and which includes means via which undesirable overcooling of the system due to external influences can be prevented.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this a flow rate of 167 Liter/min (viz., $4000-60\times\frac{1}{4}$) must be produced by the water pump. This of course undesirably consumes a number of otherwise useful horsepower.

With the above type of engine cooling system, the temperature of the coolant is prevented from boiling and maintained within a predetermined narrow temperature range usually 80 to 90 degrees) irrespective of the load and/or mode of operation of the engine, despite the fact that it is advantageous from the point of fuel economy to raise the temperature of the engine during low-medium load "urban" cruising, to increase the thermal efficiency of the engine, and reduce same during high speed and/or high load (full throttle) modes of operation for engine protection and charging efficiency.

One arrangement which has attempted to overcome the above mentioned problems is disclosed in Japanese Patent Application First Provisional Publication No. Sho 58-5449. This arrangement senses the temperature of the combustion chamber walls and controls an electrically powered water pump in accordance therewith. However, as in the arrangement disclosed hereinbefore, still a large volume of water or like coolant is required and during high load operation the electric pump is continuously energized consuming similar large amounts of energy.

Another arrangement via which the temperature of the engine may be varied in response to load is disclosed in U.S. Pat. No. 2,420,436 issued on May 1947 in the name of Mallory. This document discloses an arrangement wherein the volume of water in the radiator system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required, the temperature by which the coolant can be increased is limited by the fact that the water is prevented from boiling and in that the notable mass of water increases the weight and slows engine warm-up.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system the pressure is maintained at atmospheric level in order to maintain the boiling point of the coolant constant and thus lacks any response to changes in engine load and speed. In order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawbacks that the pressure within the engine coolant jacket is maintained essentially constant thus rendering and load responsive temperature control impossible, and further in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

Another air purge arrangement for a so called "vapor cooled" type engine of the nature disclosed hereinabove in connection with U.S. Pat. No. 4,367,699, is found in U.S. Pat. No. 2,229,946 issued in Aug. 11, 1942 in the name of Karig. This arrangement includes a heat sensitive bulb which is subject to the interior of the condensor or radiator. The bulb contains a volatile liquid and controls the opening and closing of a diaphragm valve. With this arrangement, upon a sufficiently high temperature prevailing in the condensor, the diaphram valve closes a vent port through which air and the like is discharged during intial warm-up. However, this arrangement aims at maintaining a uniform temperature regardless of variations in the conditions to which the engine is exposed and accordingly lacks any ability to vary the engine temperature in response to changes in engine speed and engine load and in no way seeks to induce conditions which minimize the tendancy for contaminating air to leak back into the system when it cools down after operation.

SUMMARY OF THE INVENTION

It is an object of the present invention to provide a cooling system for an internal combustion engine wherein a liquid coolant is boiled and the vapor used as heat transfer medium, which can be operated in a manner as to control the pressure within the system to levels appropriate for the given mode of engine operation and which via the use of simple apparatus obviates overcooling of the system due to external influences.

It is a further object to provide a system which minimizes the tendancy for air or the like contaminating non-condensible matter to be inducted into the system, and which further enables the purging of such matter.

In brief, the above mentioned objects are fullfilled by embodiments of the present invention which take the form of an internal combustion engine cooling system wherein the coolant is boiled and the vapor produced condensed in a radiator in a manner that the rate of condensation under light engine load is maintained at a level sufficiently low to raise the pressure within the system and thus raise the boiling point of the coolant while under heavy load increased to the point of lowering the pressure in the system and thus lower the coolant boiling point, a reservoir and valve arrangement is provided which permits additional coolant to be inducted into the system, in the event that an excessively low or negative pressure occurs (due to uncontrollable external influences), under the influence of the pressure differential which is established between the ambient atmosphere and the interior of the system. The coolant thus inducted is permitted to be displaced back out to the reservoir only when the pressure in the system is restored to the desired level.

The present invention in its broadest sense, takes the form of a method of cooling a device which features boiling a liquid coolant in a coolant jacket, condensing the vapor produced in the boiling step, in a radiator and using a pressure differential between a reservoir and the coolant jacket to induct additional liquid coolant from the reservoir into the radiator.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with a description of the embodiment of the present invention, it is deemed appropriate to discuss the concept on which the present invention is based.

Figure 1:
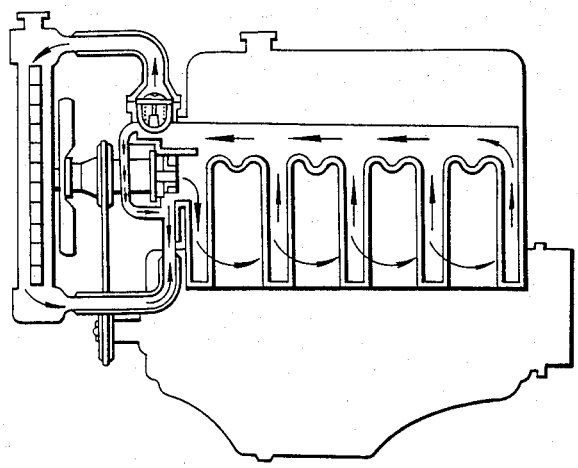
FIG.1 (PRIOR ART)
FIG. 1 is a sectional side elevation of a prior art cooling system discussed in the opening paragraphs of the instant disclosure wherein liquid coolant is continuously circulated between the engine coolant jacket and a radiator.
Figure 4:
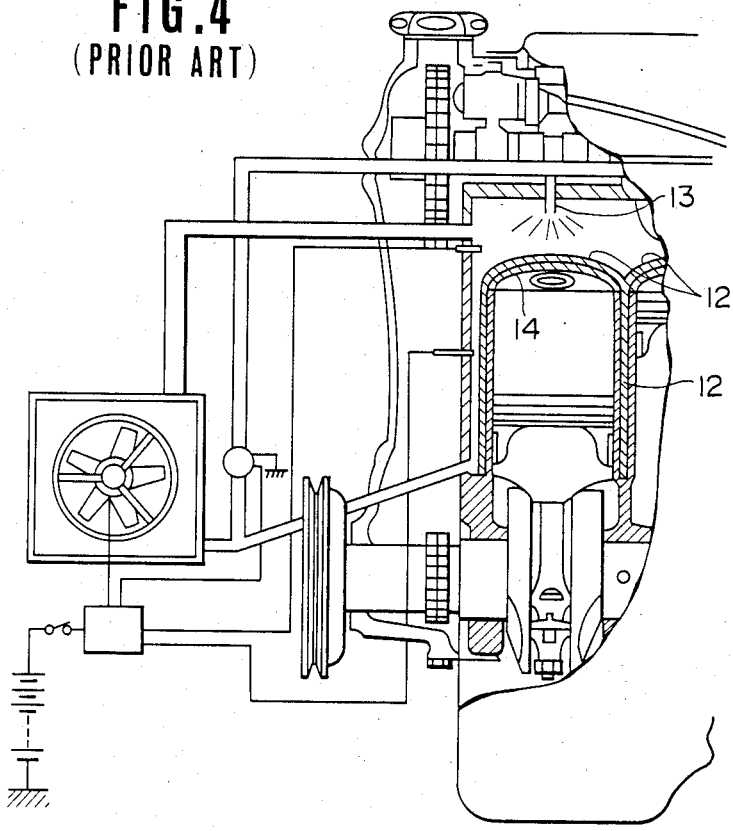
FIG.4 (PRIOR ART)
FIG. 4 is a partially sectioned view of a fourth prior art arrangement discussed briefly in the opening paragraphs of the instant disclosure.
Figure 2:
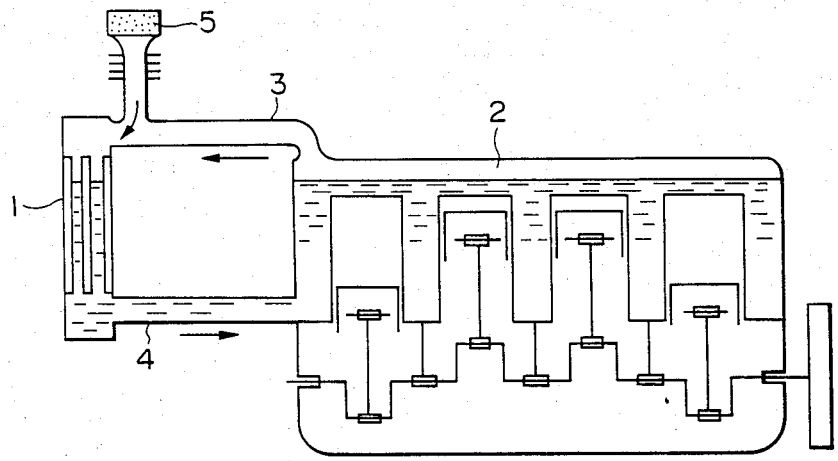
FIG. 2 (PRIOR ART)
FIG. 2 is a schematic side elevation of a second prior art cooling system discussed in the opening paragraphs of the instant disclosure.
Figure 3:
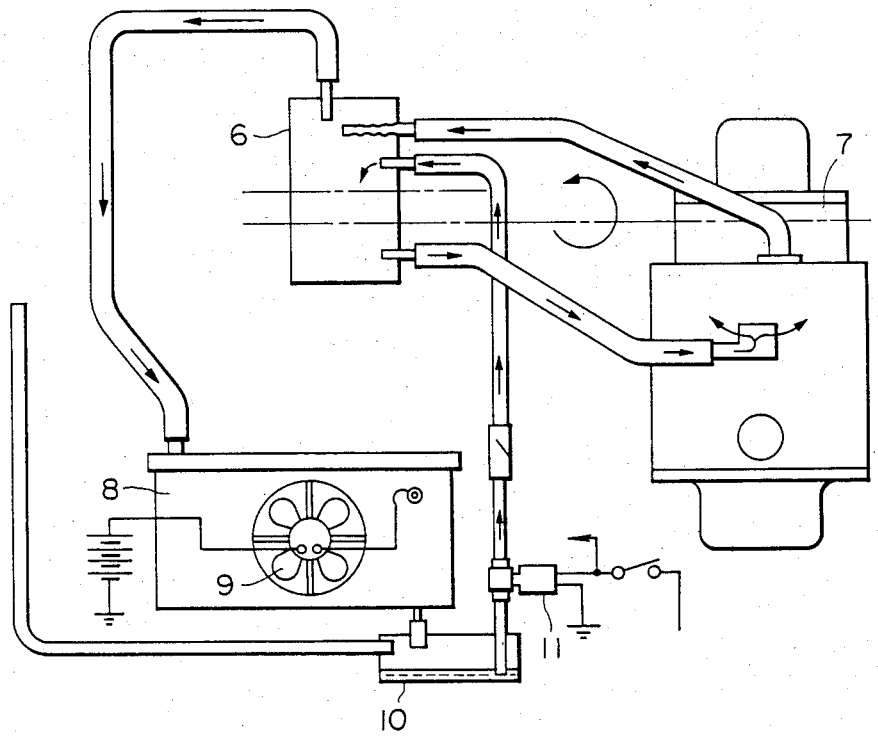
FIG. 3 (PRIOR ART)
FIG. 3 is a schematic view of a third prior art arrangement.
Figure 5:
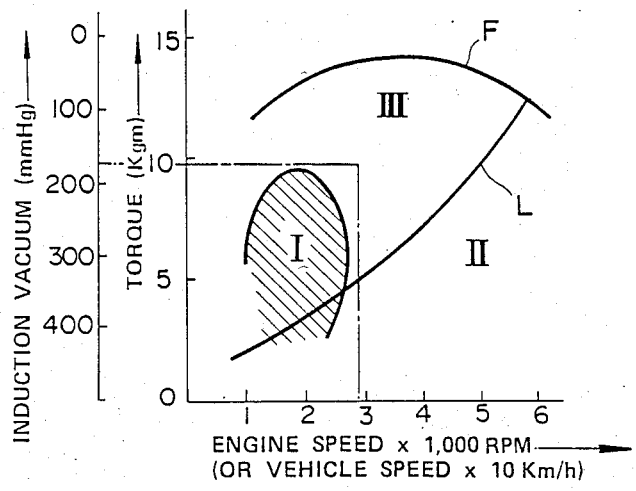
FIG. 5 is a graph showing, in terms of load (torque or induction pressure) and engine speed, the various load zones encountered by internal combustion engines.

FIG. 5 graphically shows in terms of engine torque and engine speed the various load "zones" which are encountered by an automotive vehicle engine. In this graph, the the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110°–120° C. while 90°–100° C. for zones II and III. The high temperature during "urban cruising" of course promotes improved fuel economy while the lower temperatures prevent engine knocking and/or engine damage in the other zones.

Figure 7:
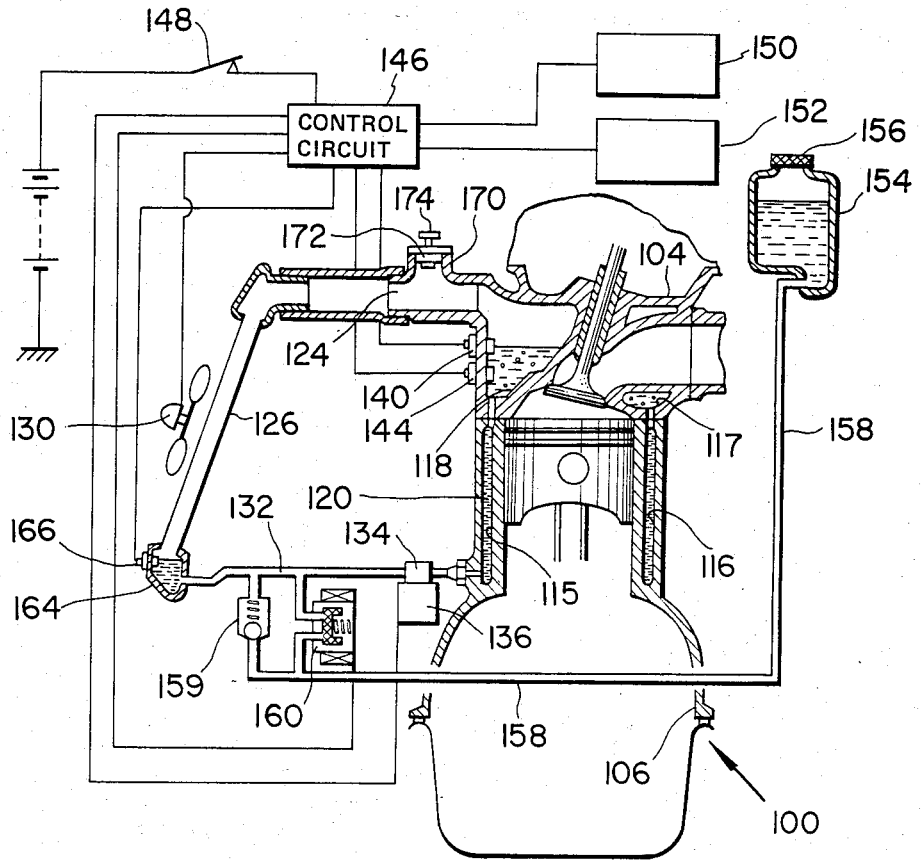
FIGS. 7 to 10 show an engine system incorporating a first embodiment of the present invention.
Figure 8:
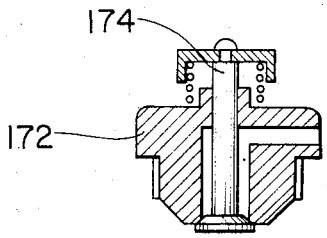
Figure 9:
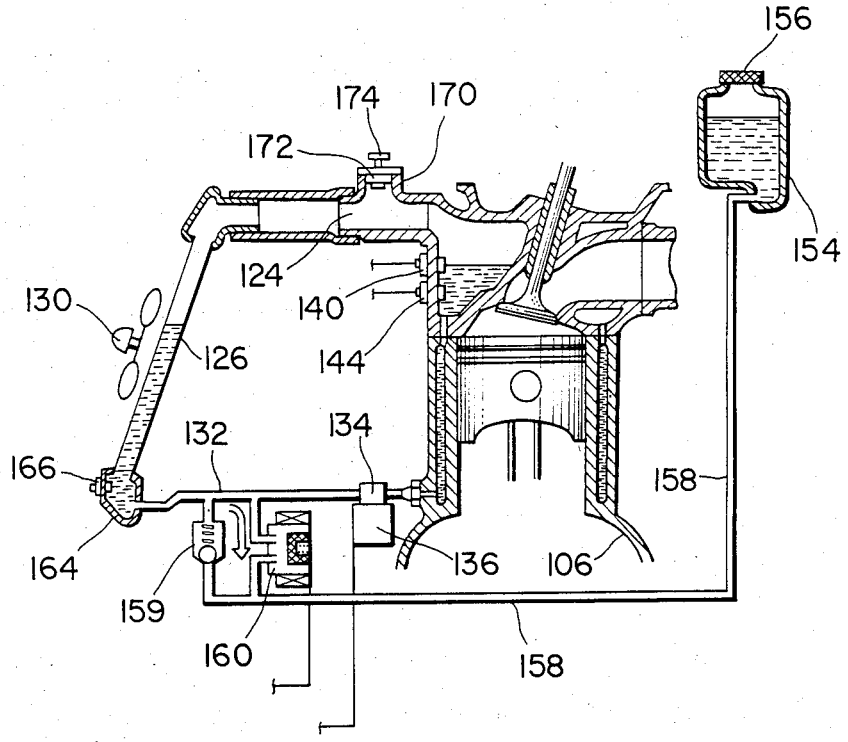

With the present invention, in order to control the temperature of the engine, advantage is taken of the fact that with a cooling system wherein the coolant is boiled and the vapor used a heat tansfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C.-for example at approximately 119° C. (corresponding to a pressure of approximately 1.9 Atmospheres).

On the other hand, during high speed cruising, it is further possible by increasing the flow of cooling air passing over the radiator, to increase the rate of condensation within the radiator to a level which reduces the pressure prevailing in the cooling system to atmospheric and thus induce the situation wherein the coolant boils at 100° C.

Figure 6:
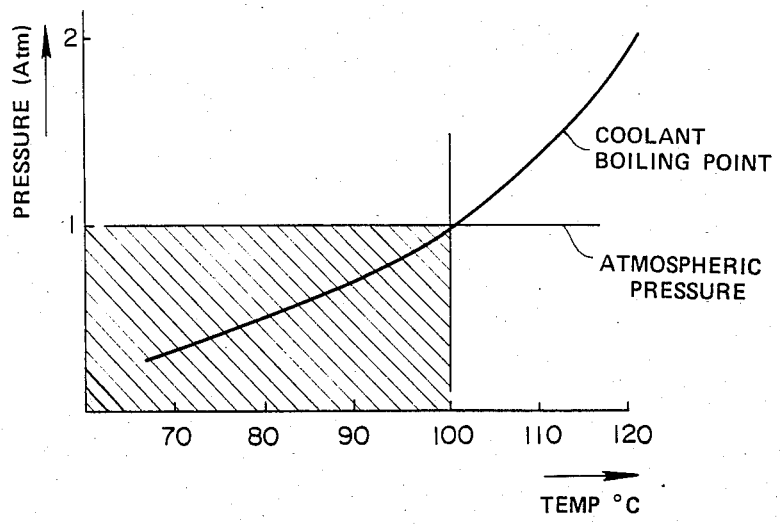
FIG. 6 is a graph showing, in terms of pressure and temperature, the change of boiling point which occurs which change of pressure within the cooling system according to the present invention.

However, under certain circumstances, such as prolonged downhill coasting or during extremely cold weather, it is possible that the rate of condensation in the radiator becomes excessive, lowering the boiling point of the coolant below that desired under such conditions and inducing a negative pressure (see hatched area in FIG. 6) sufficient to collapse the hosing and/or crush some of the engine apparatus. Accordingly, the present invention features an arrangement for reducing the heat exchange capacity of the radiator and thus limit the amount of heat which may be removed from the engine under such circumstances. In the embodiment of the present invention, this reduction in heat exchange capacity is achieved by using the negative pressure which tends to develop under such conditions to induct coolant from a reservoir and partially fill the radiator with liquid coolant. This reduces the surface area available for the vapor to release its latent heat of vaporization and thus the amount of heat which may be released from the system.

FIGS. 7 to 10 show an engine system incorporating a first embodiment of the present invention. In this arrangement, an internal combustion engine 100 includes a cylinder block 106 on which a cylinder head 104 is detachably secured. The cylinder head and cylinder block include suitable cavities 115–118 which define a coolant jacket 120 about the heated portions of the cylinder head and block.

Fluidly communicating with a vapor discharge port 124 of the cylinder head 104 is a radiator or heat exchanger 126. It should be noted that the interior of this radiator 126 is maintained essentially empty of liquid coolant during normal engine operation so as to maximize the surface area available for condensing coolant vapor (via heat exchange with the ambient atmosphere) and that the cooling system as a whole (viz., coolant jacket, radiator etc.) is hermetically sealed when the engine is warmed-up and running.

If deemed advantageous a mesh screen or like separator (not shown) can be disposed in the vapor discharge port of the cylinder head so as to minimize the transfer of liquid coolant which tends to froth during boiling, to the radiator 126.

Located suitably adjacent the radiator 126 is a electrically driven fan 130. Disposed in a coolant return conduit 132 is a return pump 134. In this embodiment, the pump is driven by an electric motor 136 and arranged to introduce the cooled discharged therefrom, into the lowermost portion of the coolant jacked 120.

In order to control the level of coolant in the coolant jacket, a level sensor 140 is disposed as shown. It will be noted that this sensor is located at a level higher than that of the combustion chambers, exhaust ports and valves (structure subject to high heat flux) so as to maintain same securely immersed in coolant and therefore attenuate engine knocking and the like due to the formation of localized zones of abnormally high temperature or "hot spots".

Located below the level sensor 140 so as to be immersed in the liquid coolant is a temperature sensor 144. The output of the level sensor 140 and the temperature sensor 144 are fed to a control circuit or modulator 146 which is suitably connected with a source of EMF upon closure of a switch 148. This switch of course may advantageously be arranged to be simultaneously closed with the ignition switch of the engine (not shown).

The control circuit 146 further receives an input from the engine distributor 150 (or like device) indicative of engine speed and an input from a load sensing device 152 such as a throttle valve position sensor. It will be noted that as an alternative to throttle position, the output of an air flow meter or an induction vacuum sensor may used to indicate load.

A coolant reservoir 154 is located at a level higher the engine proper as shown. An air permeable cap 156 is used to close the reservoir in a manner that atmospheric pressure continuously prevails therein.

The reservoir 154 fluidly communicates with the return conduit 132 via a supply conduit 158, a one-way check valve 159 and an electromagnetic valve 160. The two valves are in this embodiment arranged in parallel.

A small collection tank or reservoir 164 is provided at the bottom of the radiator 126. A second level sensor 166 is disposed in the reservoir 164.

The one-way check valve 159 is arranged to remain closed until a pressure differential exists between the reservoir and the coolant jacket. The electromagnetic valve 160 is arranged to be normally closed and energized to open only when both of the temperature sensor 144 and the second level sensor 166 indicate that the temperature of the coolant is above a predetermined level and the level of the coolant in radiator 126 is above the level sensor 166, respectively.

The cylinder head 104 is formed with a riser-like portion 170. This riser is closed by a cap 172 which includes a manually operable valve 174. In this case, the valve 174 is normally closed and opened only upon manual force being applied to the top thereof.

Prior to use, the cooling system is filled to the brim with coolant (for example water or a mixture of water and antifreeze or the like) and the cap 172 securely set in place to seal the system. A suitable quantity of additional coolant is also poured into the reservoir 154.

When the engine is started, as the system is completely filled with coolant, very little heat can be removed from the engine and the coolant quicky warms. Upon reachng the temperature at which the electromagnetic valve 160 is energized, it is possible to permit any air in the system, such as that dissolved in the coolant per se, and which tends to be forced out of solution by the heating and rises to collect in the riser portion 170, to be purged out of the system simply by manually opening the valve 174 and allowing a little coolant to be bled out under the influence of gravity (it being noted that the reservoir 154 is located above that of the cap 172 and valve 174. Subsequently, as the temperature and coolant level are both above the previously mentioned predetermined levels, the coolant temperature continues to rise and generates sufficient vapor pressure within the system to displace the coolant back out through valve 160 (open) to the reservoir 154. This procedure continues until the first level sensor 140 is uncovered whereafter the the pump 134 is energized to induct coolant from the radiator 126 and discharges same into the cylinder block 106. This empties the radiator 126 while maintaining the level of the coolant within the cylinder block at that of the first level sensor 140 (see FIG. 9). This procedure is continued until the level of coolant in the radiator 126 falls to that of the second level sensor 166, whereupon the valve 160 is closed via de-energization and system placed in a "closed" condition (see FIG. 7).

In order to control the temperature within the coolant jacket the control circuit 146 selectively energizes the motor of the fan 130 in a manner to induce a rate of condensation in the radiator which controls the pressure prevailing in the cooling system to a level whereat the coolant boils at a temperature suited to the particular load and/or engine speed conditions of the engine.

Figure 10:
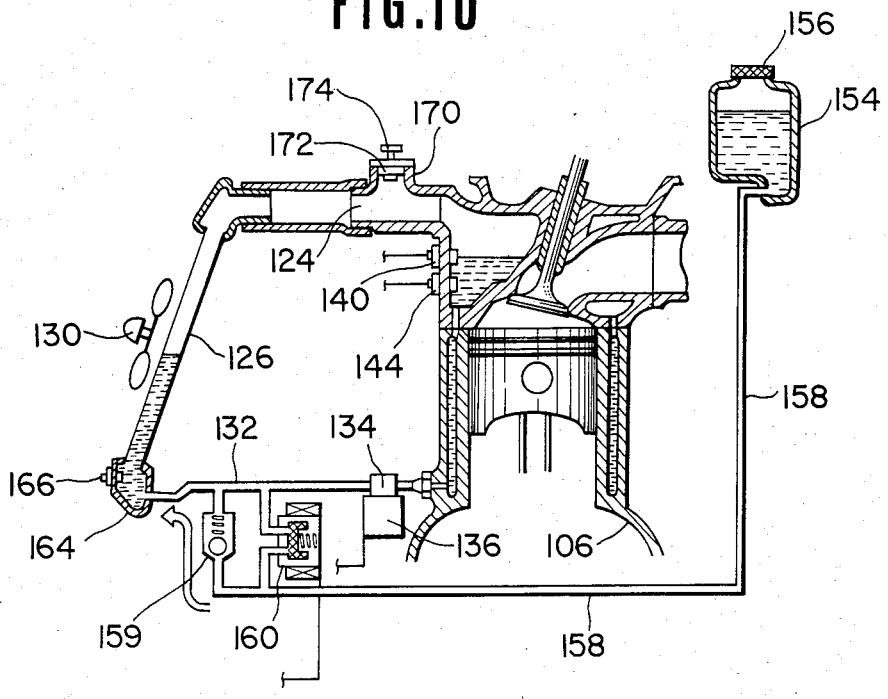

However, should the rate of condensation within the radiator increase due to external influences and the pressure within the system fall below the predetermined low level, the pressure differential produced across the one-way check valve opens same and permits coolant to be inducted into the system (see FIG. 10). Due to the provision of the pump 134 the newly introduced coolant tends to flow predominently toward and into the radiator 126 thus partially filling same. This reduces the amount of heat which may be released to the ambient atmosphere and thus tends to cause the temperature and pressure within the system to stabilize and/or increase. Upon a pressure equilibrium being established, coolant ceases to be inducted into the system. This situation is maintained until the temperature and pressure conditions increase to the level whereat the electromagnetic valve is opened and the excess coolant in the radiator is suitably displaced back to the reservoir (see FIG. 9).

Upon stoppage of the engine 100, the vapor pressure within the radiator 126 and coolant jacket 120 falls due to the cooling of the engine and the condensation of the vapor therein. Under these circumstances coolant flows into the system from the reservoir 154 via valve 159 under the influence of both gravity and the atmospheric pressure acting on the surface of the coolant in the reservoir, until the system is filled.

Filling of the cooling system in this manner obviates any tendancy for sub-atmospheric conditions to prevail and hence for any air to be inducted.

Figure 11:
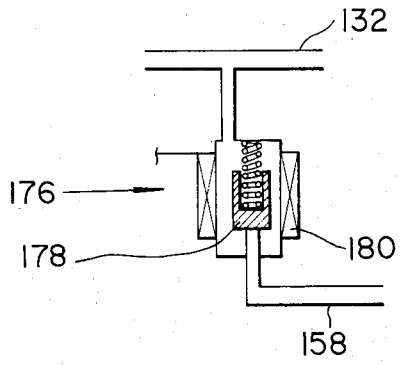
FIG. 11 shows a valve arrangement which characterizes a second embodiment of the present invention.

FIG. 11 shows a valve 176 which characterizes a second embodiment of the present invention. In this embodiment the two individual valves 159 and 160 are replaced with this single unit. As shown, the valve element 178 of the valve 176 is biased to close the supply conduit 158 by a spring. This spring is so selected that the above mentioned predetermined presure differential will overcome same allowing communication between the reservoir 154 and the radiator 126 when negative pressure prevails within the sytem. The solenoid 180 of this valve is arranged to move the valve element 178 to an open position upon energization.

Figure 12:
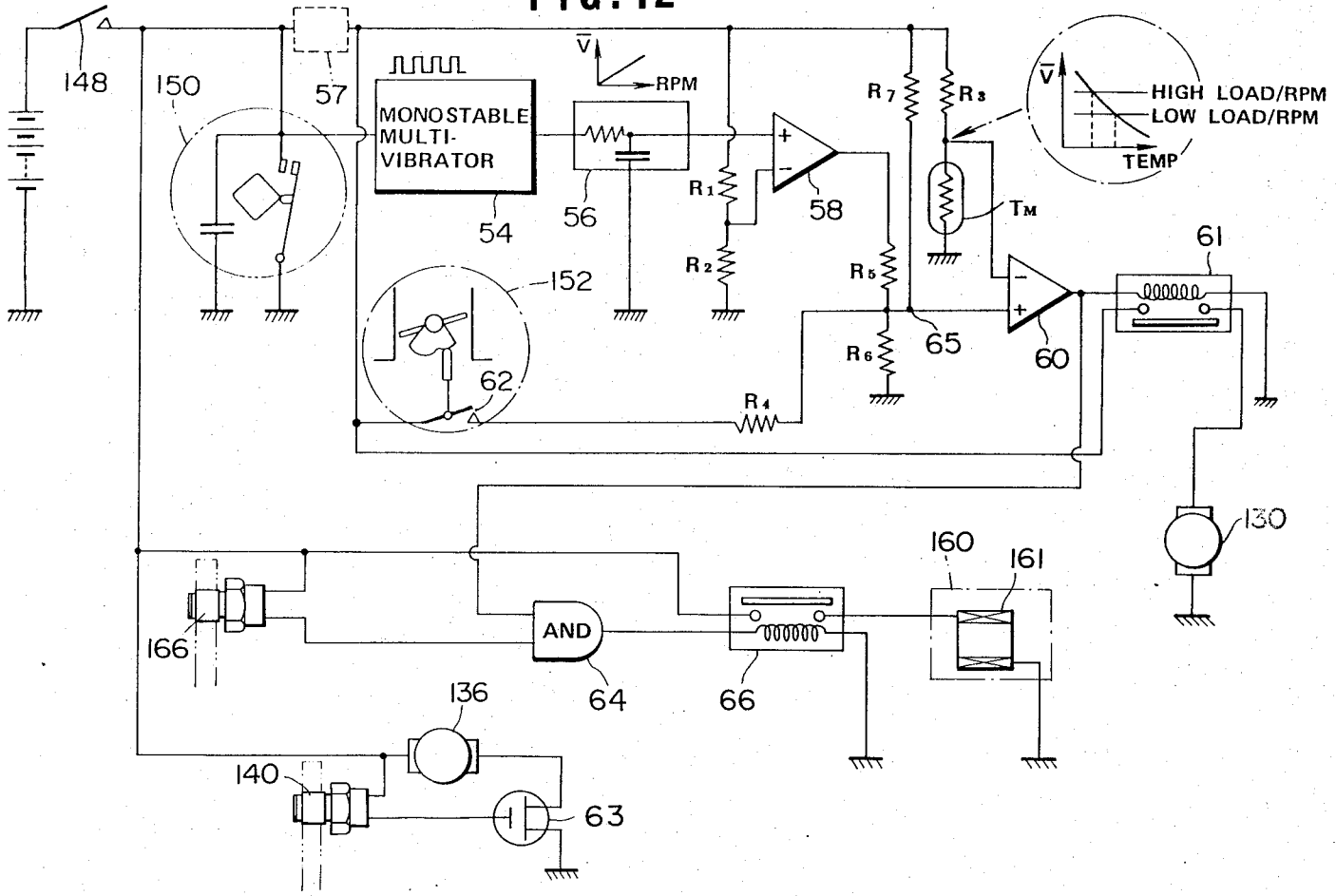
FIGS. 12 and 13*a–c* show circuit arrangements suitable for controlling the operation of the embodiment of the invention.

FIG. 12 shows a circuit suitable for controlling electromagnetic valve 160, pump 134 and fan 130 of the first embodiment.

In this circuit arrangement the distributor 150 of the engine ignition system is connected with the source of EMF via the switch 148. A monostable multivibrator 54 is connected in series between the distributor 150 and a smoothing circuit 46. A DC-DC converter 57 is arranged, as shown in broken line, to ensure a supply of constant voltage. A first voltage divider consisting of resistors R1 and R2 provides a comparator 58 with a reference voltage at its inverting input (−) thereof while the non-inverting input (+) of said comparator receives the output of the smoothing circuit 56. A second voltage dividing arrangement consisting of a resistor R3 and a thermistor $T_M$ (viz., the heart of the temperature sensor 144) applies a variable voltage to a second comparator 60 which also receives a signal from a cam operated throttle switch 62 via a resistor arrangement including resistors R4, R5, R6 and R7 connected as shown. The output of the comparator 60 is applied to the fan 130 via a relay 61 for energizing same.

The circuit further includes a transistor 63 which acts a switch upon receiving an output from the level sensor 140 to establish a circuit between the source of EMF and ground. As a safety measure, an inverter or the like (not shown) may be interposed between the level sensor 140 and the transistor 63, and the level sensor adapted to produce an output when immersed in coolant. With this arrangement should the level sensor malfunction, the lack of output therefrom causes the transistor 63 to be continuously rendered conductive and the pump motor 136 continually energized to ensure that an adequate amount of coolant is maintained in the coolant jacket.

In order to achieve the desired control of valve 160, the outputs of level sensor 166 and comparator 60 are applied to an AND gate 64. The output of the AND gate 64 is applied to the coil of a relay 66, which, when closed, supplys current to the solenoid 161 of valve 160.

As will be appreciated, with the disclosed circuit, depending on the load and engine speed, the temperature of the coolant in the coolant jacket 120 will be adjusted in a manner that at low engine speeds and loads the voltage appearing at the inverting terminal of the comparator will be compared with the voltage appearing on the non-inverting terminal thereof and the fan 130 suitably energized to maintain a high temperature under so called "urban cruising" conditions and lowered at high load/speed operation. Further, upon level sensor 166 and comparator 60 simultaneously outputting high level signals, solenoid 161 of valve 160 will be energized to open same.

Figure 13:
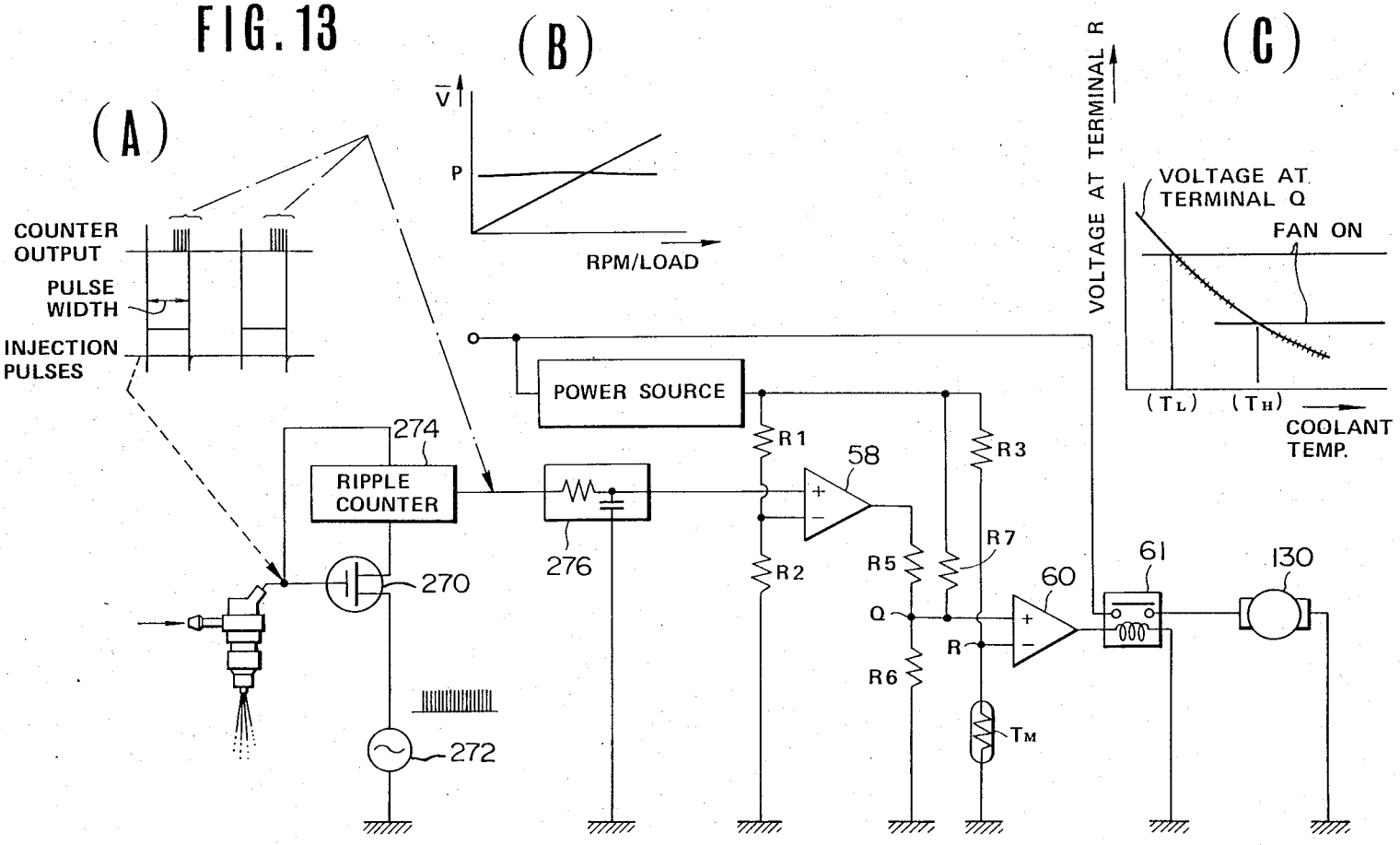

FIG. 13 shows a second circuit arrangement which may be employed in the case the engine is equipped with a fuel injection system.

This alternative arrangement differs from that shown in FIG. 12 by the inclusion of a transistor 270, a clock circuit 272, a ripple counter 274 and a smoothing circuit 276, all connected as shown. Due to the fact that the frequency of injection control pulses varies with engine speed and the voltage output of the smoothing circuit 276 varies with pulse width as well as the frequency of injection, it is possible to use this arrangement in place of both of the throttle switch 62 and distributor 150 as will be appreciated by those skilled in the art. For the sake of simplicity the level sensors 140 & 166 and associated circuitry have been omitted from this figure.

More specifically, the operation of the FIG. 7 circuit is such that when the injector driving signal is applied to the base of the transistor 270 and the output of the clock generator 272 is fed to the ripple counter 274. The characteristics of the ripple counter 274 are so selected that it outputs a carry only when the width of the injection pulses are greater than a predetermined value (viz., indicative of a load in excess of a predetermined value). The injection driving pulses are applied to the reset terminal of the counter 274. Upon the width of the injection pulse exceeding said predetermined value, the ripple counter 274 will output a carry (a number of clock pulses) which varies with the width of the pulse in excess of the predetermined value, as will be clear from insert "A". The output of the smoothing circuit 276 accordingly increases with engine speed and load (pulse width). The output of the smoothing circuit 276 is applied to the non-inverting terminal (+) of the comparator 58 which receives a fixed reference voltage from the voltage divider defined by resistors R1 and R2 on its inverting one (−). Accordingly, upon the voltage level of the smoothing circuit 276 output exceeding that provided by the R1−R2 voltage divider (see voltage P in insert "B"), the comparator produces an output to terminal Q.

The voltage appearing at terminal R decreases with increase of coolant temperature due to the inherent characteristics of the thermistor $T_M$. Accordingly, if the voltage appearing on terminal R is at a high level due to the engine operating at high load/speed conditions, the fan 130 will be energized to maintain a low coolant temperature ($T_L$) as will be clear from insert "C". On the other hand, should the engine be operating under the so called "urban cruising" conditions, the voltage appearing on terminal Q will be low due to absence of an output from the comparator 58 and the fan 130 will be operated in a manner to reduce the rate of condensation in the radiator 126 and raise the temperature of the coolant to a high level ($T_H$).

It will be noted that, if deemed advantageous the temperature of the engine coolant may be varied continuously with change in load and/or engine speed as different form the stepwise control disclosed hereinbefore. This may be achieved by omitting comparators 58 and replacing the cam operated switches 62 with variable resistors so that the voltage appearing on the non-inverting inputs of comparators 60 will gradually vary with load and engine speed.

What is claimed is:

1. In a method of a coolant an arrangement, the steps of:

boiling a liquid coolant in a coolant jacket;

condensing the vapor produced in said boiling step, in a radiator;

maintaining said radiator essentially empty of liquid coolant when the engine is warmed-up and running so as to maximize the surface area available for coolant vapor to release its latent heat of evaporation;

storing coolant in a reservoir in fluid communication with said radiator; and reducing the surface area of said radiator via which the vapor produced in said coolant jacket can release its latent heat of evaporation by using a pressure differential between said reservoir and said radiator which develops when the pressure in said radiator falls a predetermined amount below that prevailing in said reservoir to induct additional coolant from said reservoir into said radiator.

2. A method as claimed in claim 1, further comprising the steps of:

permitting the additional liquid coolant inducted into said radiator to be discharged back to said reservoir when one of the temperature and pressure within said coolant jacket has exceeded a predetermined level.

3. A method of cooling an arrangement comprising the steps of:

boiling a liquid coolant in a coolant jacket;

condensing the vapor produced in said boiling step, in a radiator;

using a pressure differential between a reservoir and said coolant jacket to induct additional liquid coolant from said reservoir into said radiator;

permitting the additional liquid coolant inducted into said radiator to be discharged back to said reservoir when one of the temperature and pressure within said coolant jacket has exceeded a predetermined level;

sensing the level of coolant at the bottom of said radiator;

sensing one of the temperature and pressure in one of said radiator and said coolant jacket; and opening a normally closed valve which controls fluid communication between said radiator and said reservoir when said step of sensing the coolant level indicates that there is more than a predetermined amount of liquid coolant in said radiator and said step of sensing one of the temperature and pressure indicates that the temperature or pressure in said coolant jacket is above a predetermined level.

4. A method as claimed in claim 3, further comprising:

sensing an operational parameter of said device; and controlling a device which varies the rate of condensation in said radiator in accordance with the magnitude of said sensed operational parameter.

5. In an internal combustion engine having a combustion chamber:

a radiator;

a coolant jacket in which liquid coolant is boiled and the vapor produced conveyed to said radiator for condensation therein;

a reservoir containing liquid coolant; and a first valve fluidly interposed between said radiator and said reservoir which opens in response to a pressure developing in said radiator which is a predetermined amount lower than that prevailing in said reservoir, said first valve being a check valve which permits flow of coolant from said reservoir to said radiator, but which prevents flow of coolant from said radiator to said reservoir.

6. An internal combustion engine as claimed in claim 5, further comprising:

a first parameter sensor for sensing a first engine operation parameter; and a device responsive to said first sensor for varying the rate of condensation of said vapor in said radiator.

7. An internal combustion engine as claimed in claim 5, wherein said first valve provides unrestricted fluid communication between said reservoir and said radiator when open and which cuts off communication therebetween when closed.

8. An internal combustion engine having a combustion chamber comprising:

a radiator;

a coolant jacket in which liquid coolant is boiled and the vapor produced conveyed to said radiator for condensation therein;

a reservoir containing liquid coolant;

a first pressure differential responsive valve which controls fluid communication between said reservoir and said radiator and through which liquid coolant from said reservoir is inducted upon a negative pressure developing in said coolant jacket;

a first parameter sensor for sensing a first engine operation parameter;

a device responsive to said first sensor for varying the rate of condensation of said vapor in said radiator;

a second parameter sensor for sensing a parameter which varies with one of the temperature and pressure within said coolant jacket;

a first level sensor disposed at the bottom of said radiator; and a second valve which controls fluid communication between said reservoir and said radiator and which is arranged to open when said second parameter sensor indicates that the temperature within said coolant jacket is above a predetermined level said first level sensor indicates that the level of coolant in said radiator is above that of said first level sensor.

9. An internal combustion engine as claimed in claim 8, further comprising:

a second level sensor disposed in said coolant jacket a level higher than said combustion chamber; and a pump responsive to said first level sensor for returning condensed coolant from said radiator to said coolant jacket in a manner which maintains the level of liquid coolant in said coolant jacket at essentially the level of said second level sensor, said pump being disposed in a return conduit which leads from said radiator to said coolant jacket.

10. An internal combustion engine as claimed in claim 8, wherein said reservoir is arranged at a level higher than said coolant jacket and said radiator.

11. An internal combustion engine as claimed in claim 10, further comprising a bleed valve arranged at the top of one of said radiator and coolant jacket and which may be opened to permit non-condensible matter to be discharged from said radaitor and coolant jacket.

* * * * *